US007992652B2

(12) United States Patent
Plunkett

(10) Patent No.: US 7,992,652 B2
(45) Date of Patent: Aug. 9, 2011

(54) FLUID DISTRIBUTOR CYLINDER FOR PERCUSSIVE DRILLS

(75) Inventor: Timothy J. Plunkett, Roanoke, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 253 days.

(21) Appl. No.: 12/366,014

(22) Filed: Feb. 5, 2009

(65) Prior Publication Data

US 2010/0193208 A1 Aug. 5, 2010

(51) Int. Cl.
*E21B 4/14* (2006.01)

(52) U.S. Cl. ..... 173/13; 173/14; 173/15; 173/16; 173/17; 173/90; 173/91; 173/206; 175/296; 91/218; 91/235; 91/224; 251/341; 251/343; 251/344

(58) Field of Classification Search ..... 173/13–17, 173/91, 206, 90; 175/296; 91/218, 235, 91/224; 251/341, 343, 344
See application file for complete search history.

(56) References Cited

U.S. PATENT DOCUMENTS

| | | | | |
|---|---|---|---|---|
| 3,169,584 | A * | 2/1965 | Stenuick | 173/18 |
| 3,640,350 | A * | 2/1972 | Stenuick | 173/61 |
| 4,084,647 | A | 4/1978 | Lister | |
| 4,146,097 | A | 3/1979 | Curington | |
| 4,512,417 | A * | 4/1985 | Kurt | 173/77 |
| 4,821,812 | A | 4/1989 | Ditzig | |
| 5,085,284 | A | 2/1992 | Fu | |
| 5,139,095 | A | 8/1992 | Lyon et al. | |
| 5,143,162 | A | 9/1992 | Lyon et al. | |
| 5,240,083 | A | 8/1993 | Lyon | |
| 5,301,761 | A | 4/1994 | Fu et al. | |
| 5,325,926 | A | 7/1994 | Lay et al. | |
| 5,390,749 | A | 2/1995 | Lyon | |
| 5,562,170 | A | 10/1996 | Wolfer et al. | |
| 5,566,771 | A | 10/1996 | Wolfer et al. | |
| 5,647,447 | A | 7/1997 | Jones | |

(Continued)

FOREIGN PATENT DOCUMENTS

GB 1474501 5/1977

OTHER PUBLICATIONS 06751696.3 extended European Search Report dated Dec. 23, 2009 (4 pages).

(Continued)

*Primary Examiner* — Rinaldi I. Rada
*Assistant Examiner* — Michelle Lopez
(74) *Attorney, Agent, or Firm* — Michael Best & Friedrich LLP

(57) ABSTRACT

A fluid distributor cylinder is for a percussive drill assembly that includes a casing having an inner circumferential surface defining a central bore, a central axis extending through the bore, a bit movably coupled with the casing and a piston movably disposed within the casing bore. The distributor cylinder includes a generally tubular body disposeable within the casing bore and having first and second ends, a central axis extending generally between the first and second ends, an outer circumferential surface. At least a section of the outer surface is configured to engage with the inner surface of the casing so to form an interference fit between the body and the casing. The cylinder includes an exterior thread and/or a radially-extending shoulder configured to releasably engage with the casing inner surface so as to substantially prevent axial displacement of the distributor body with respect to the casing.

20 Claims, 10 Drawing Sheets

U.S. PATENT DOCUMENTS

| | | | | |
|---|---|---|---|---|
| 5,682,957 | A | 11/1997 | Lyon | |
| 5,699,867 | A | 12/1997 | Jones | |
| 5,711,205 | A | 1/1998 | Wolfer et al. | |
| 5,735,358 | A | 4/1998 | Lyon | |
| 5,794,516 | A | 8/1998 | Wolfer et al. | |
| 6,135,216 | A | 10/2000 | Lyon et al. | |
| 6,170,581 | B1 | 1/2001 | Lay | |
| 6,237,704 | B1 | 5/2001 | Lay | |
| 6,668,942 | B1 * | 12/2003 | Lin | 173/211 |
| 6,799,641 | B1 | 10/2004 | Lyon et al. | |
| 7,159,676 | B2 | 1/2007 | Lyon | |
| 7,467,675 | B2 | 12/2008 | Lay | |
| 7,469,626 | B2 * | 12/2008 | Rateick et al. | 92/171.1 |
| 7,624,822 | B2 | 12/2009 | Olsson et al. | |
| 7,677,326 | B2 * | 3/2010 | Heep et al. | 173/48 |
| 2005/0034899 | A1 * | 2/2005 | Lyon | 175/296 |
| 2009/0308661 | A1 | 12/2009 | Wolfer et al. | |

OTHER PUBLICATIONS

PCT/US06/16126 International Search Report dated Sep. 29, 2006 (1 page).

* cited by examiner

FLUID DISTRIBUTOR CYLINDER FOR PERCUSSIVE DRILLS

The present invention relates to down-hole drills, and more particularly to devices for distributing percussive fluid in down-hole drills.

Down-bole drills typically include a piston that reciprocates within a casing and impacts upon a bit, so as to drive a bit head into cutting engagement with a work surface. The piston is generally operated by means of a percussive fluid (e.g., compressed air) which is appropriately directed onto surfaces of the piston to cause the piston to displace in opposing directions along a casing axis. Specifically, a drive chamber and a return chamber are typically defined within the casing, with fluid in the drive chamber acting to displace the piston toward the bit and fluid in the return chamber acting to displace the piston back to a drive position spaced above the bit.

To facilitate the proper channeling of percussive fluid, down-hole drills are often provided with a distributor cylinder which includes one or more passages and/or ports to direct fluid from a supply chamber into the drive and/or return chambers, and/or to direct or "exhaust" fluid out of the drive and return chambers. Such distributor cylinders may also partially define the drive, return or/and supply chambers and may interact with or provide valve components for regulating flow between two or more chambers.

SUMMARY OF THE INVENTION

In one aspect, the present invention is a fluid distributor cylinder for a percussive drill assembly, the drill assembly including a casing having an inner circumferential surface defining a central bore, a central axis extending through the bore, a bit movably coupled with the casing and a piston movably disposed within the casing bore. The distributor cylinder comprises a generally tubular body disposeable within the casing bore and having first and second ends, a central axis extending generally between the first and second ends, and an outer circumferential surface. At least a section of the body outer surface is configured to engage with the inner surface of the casing so to form an interference fit between the body and the casing. Further, the distributor body also includes an exterior thread or/and a radially-extending shoulder configured to releasably engage with the casing inner surface so as to substantially prevent axial displacement of the distributor body with respect to the casing.

In another aspect, the present invention is a drill assembly comprising a casing having an inner surface defining a central bore, a bit movably coupled with the casing, a piston movably disposed within the casing bore and contactable with the bit, and a distributor cylinder. The distributor cylinder includes a generally tubular body disposeable within the casing bore and having first and second ends, a central axis extending generally between the first and second ends, an outer circumferential surface. At least a section of the body outer surface is configured to engage with the inner surface of the casing so to form an interference fit between the body and the casing. Further, the distributor body also includes an exterior thread or/and a radially-extending shoulder configured to releasably engage with the casing inner surface so as to substantially prevent axial displacement of the distributor body with respect to the casing.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings:

FIG. 1, are each an axial cross-section view of a drill assembly including a distributor cylinder in accordance with the present invention, FIG. 1A showing a piston in an impact position and FIG. 1B showing the piston in a drive position;

DETAILED DESCRIPTION OF THE INVENTION

Figure 1A:
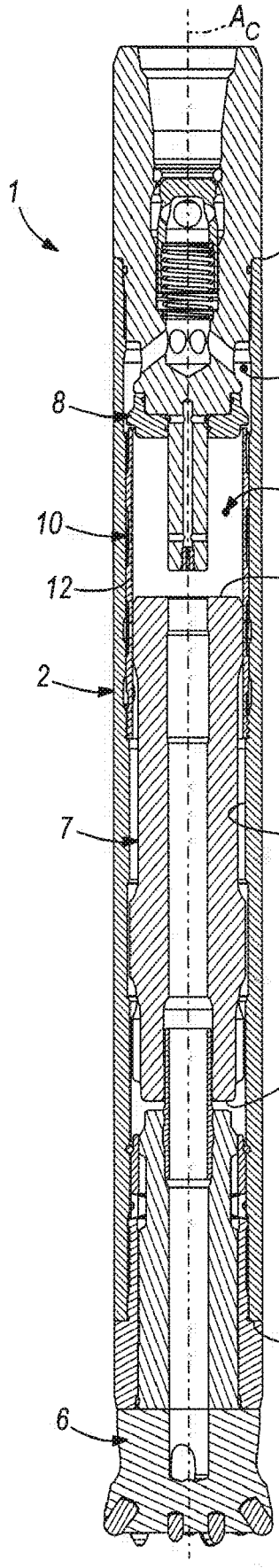
FIGS. 1A and 1B, collectively

Certain terminology is used in the following description for convenience only and is not limiting. The words "right", left", "lower", "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Referring now to the drawings in detail, wherein like numbers are used to indicate like elements throughout, there is shown in FIGS. 1-11 a fluid distributor cylinder 10 for a percussive drill assembly 1. Preferably, the drill assembly 1 includes a casing 2 with lower and upper ends 2*a*, 2*b* and having an inner circumferential surface 3 defining a central bore 4, a central axis $A_C$ extending through the bore 4 between the two ends 2*a*, 2*b*, and a fluid supply chamber 5 defined within the bore 4. A bit 6 is movably coupled with the casing 2 so as to extend outwardly from the lower end 2*a*, a piston 7 is movably disposed within the casing bore 4, and a valve member 8 is movably disposed within the casing bore 4 generally between the piston 7 and the casing upper end 2*b*, the valve 8 regulating flow from the supply chamber 5. Basically, the distributor cylinder 10 comprises a generally tubular body 12 disposeable within the casing bore 4 and configured to receive an upper portion 7*a* of the piston 7. The body 12 has first and second ends 12*a*, 12*b*, a central axis Ac extending generally between the two ends 12*a*, 12*b*, and inner and outer circumferential surfaces 13, 14, respectively. The distributor bore 4 is sized to receive the piston 7 such that the piston 7 extends through the body first end 12*a*, and the body second end 12*b* is configured to receive the valve member 8, as described in greater detail below. Further, at least a portion 15 of the outer surface 14, preferably a substantial portion of and most preferably generally the entire outer surface 14, is configured to engage with the inner surface 3 of the casing 2 so to form an interference or friction fit between the body 12 and the casing 2. Furthermore, the distributor body 12 also has either an exterior thread 16 or a radially-extending shoulder 18 (see FIG. 11) configured to releasably engage with the casing inner surface 3 so as to substantially prevent axial displacement of the distributor body 12 with respect to the casing 2.

More specifically, the exterior thread 16 or the radial shoulder 18 is configured to prevent displacement of the distributor body 12 relative to the casing 2 when an impact force $F_I$ is applied to the body 12 and/or the casing 2 that has a magnitude greater than a friction force $F_f$ between the body outer surface section 14 and the casing inner surface 3. In other words, the thread 16 or the shoulder 18 functions to retain the distributor 10 at a substantially fixed position $P_D$ on the casing axis $A_C$ even when an axial force $F_A$ is applied to the drill assembly 1 that would otherwise tend to separate the frictionally engaged surfaces 3, 15. Such a force $F_A$ may be generated in reaction to the impact force $F_I$ exerted by the bit 6 on a working surface (e.g., bottom of hole being drilled, not depicted) and the impact force of the piston 7 on the bit 6, and could potentially dislodge the cylinder 10 from the desired axial position $P_D$, and thereby cause the drill assembly 1 to malfunction. Thus, the thread 16 or shoulder 18 provides an additional safeguard to ensure proper operation of the drill assembly 1.

Figure 3:
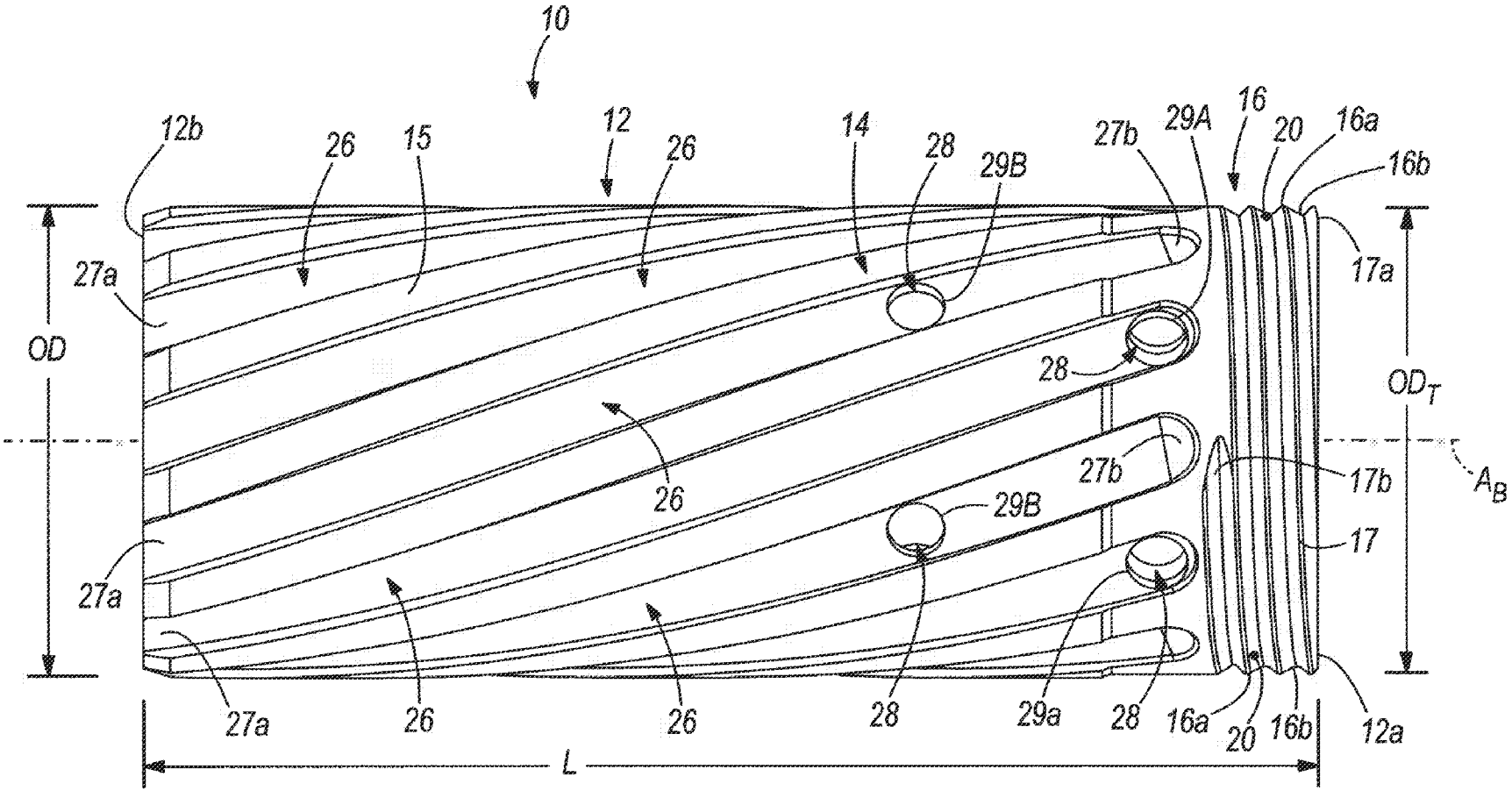
FIG. 3 is a more enlarged, side perspective view of the distributor cylinder.
Figure 4:
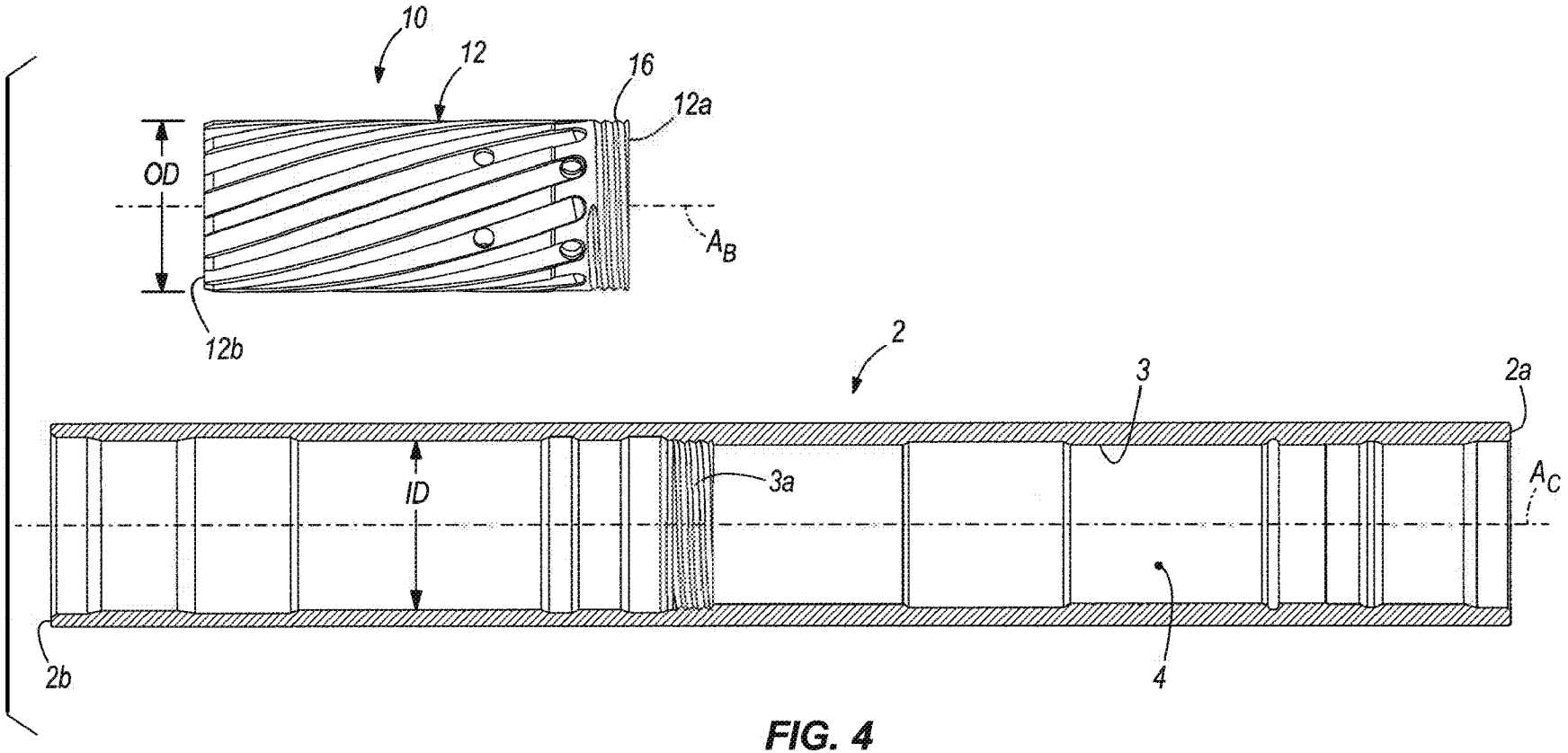
FIG. 4 is a side view of the distributor cylinder and an axial cross-sectional view of the casing.

Referring to FIGS. 3-8, the distributor body 12 is formed with an outside diameter OD that is greater than a casing inside diameter ID, such that the friction fit is formed when the distributor cylinder 10 is installed within the casing 2, as described below. Specifically, the distributor body 12 is sized such that the value of the body outside diameter OD is greater than the value of the casing inside diameter ID when the distributor cylinder 10 is separate from the casing 3, as depicted in FIG. 4. However, when the distributor cylinder 10 is disposed within the casing 2, the outer surface 14 of distributor body 12 must be disposed within the casing inner surface 3, i.e., the casing inner surface 3 extends circumferentially about the distributor outer surface 14 (see, e.g., FIG. 7). Thus, the difference between the diameters OD, ID of the unassembled components 2, 12 cause the distributor outer surface 14 to push outwardly against the casing inner surface 3, and vice-versa, thereby generating a generally radial normal force $F_N$ (FIG. 8) and a resulting generally axial frictional force $F_F$ whenever a net axial force $F_A$ is applied to either the casing 2 or the distributor body 12. Preferably, the value of the body outside diameter OD is about 0.1 percent greater than the value of the casing inside diameter ID, and most preferably the body outside diameter OD is about 0.001 inches greater the casing inside diameter ID.

Figure 6:
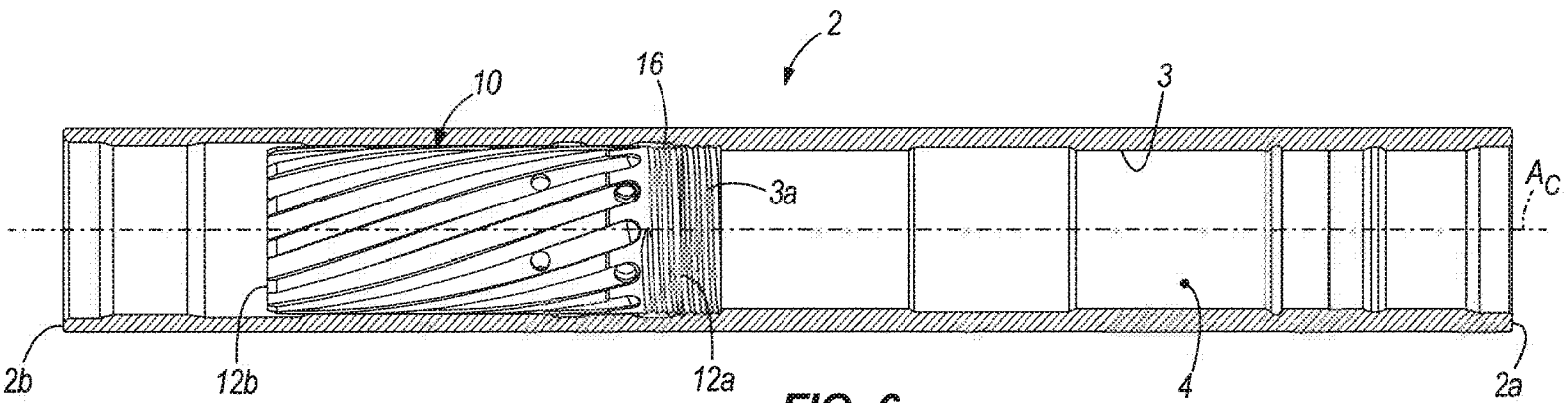
FIG. 6 is another view of the components of FIG. 4, showing the cylinder threads beginning to engage with casing threads.
Figure 7:
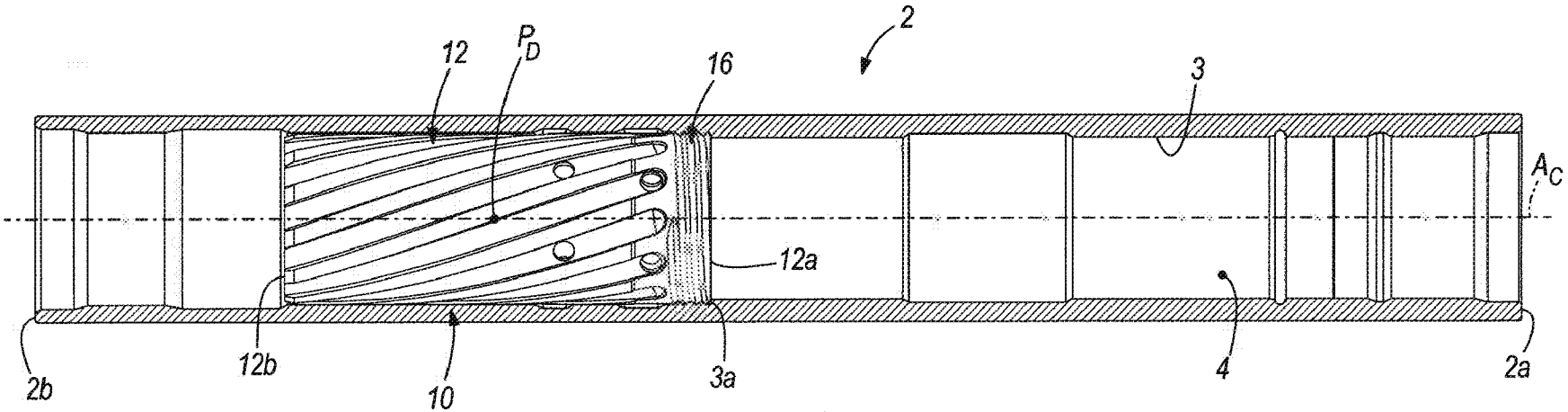
FIG. 7 is another view of the components of FIG. 4, showing the threads fully engaged such that the distributor cylinder is located at a desired axial position within the casing.
Figure 8:
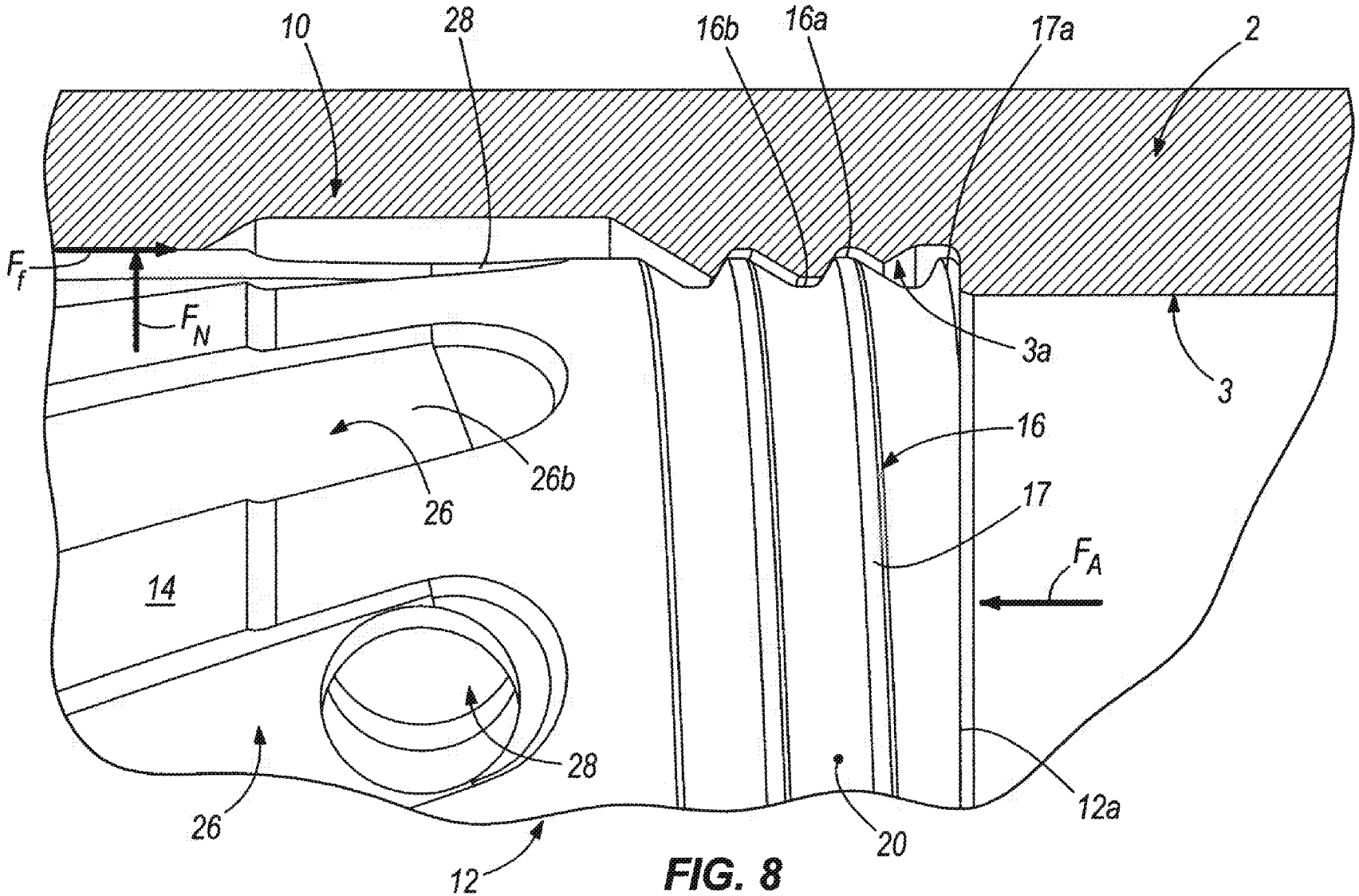
FIG. 8 is broken-away, greatly enlarged view of a section of FIG. 7.

Still referring to FIGS. 3-8, the fluid distributor 10 preferably includes a thread 16 as opposed to a shoulder, which is thus an exterior thread. The thread 16 extends circumferentially about the body axis $A_B$ and has an outer surface 17 with an outside diameter $OD_T$, which is preferably substantially equal to the main body surface section outside diameter OD. In other words, the thread 16 is preferably formed by cutting one or more grooves 20 into the body 12, i.e., radially inwardly from the body outer surface 14. As such, the crest 16*a* of the thread 16 is substantially located at the body outside diameter OD and the thread root(s) 16*b* is located at the base of the groove 20, as best shown in FIGS. 3 and 8. However, the thread(s) 16 may be formed (e.g., cast, forged, etc.) on the body 12 such that the thread(s) 16 extend radially outwardly from the outer surface 14 of the remainder of the body 12. In any case, the thread outer surface 17 is configured to engage with the casing inner surface 3, preferably with an interior thread 3*a* formed into the inner surface 3, so as to form an interference fit between the thread 16 and the casing 2 (i.e., in addition to threadably interlocking). As such, a substantial portion of outer surface 14 of the distributor cylinder 10 contributes to the axially directed friction force $F_F$ that counteracts the impact force $F_A$.

Preferably, the one or more threads 16 are formed on the distributor body 12 such that each thread 16 has a first end 17*a* located at least generally proximal to one of the body first and second ends 12*a*, 12*b* and a second end 16*b* located generally between the first and second ends 12*a*, 12*b*. In other words, each thread 16 starts at one end 12*a* or 12*b* of the body 12 and extends axially (i.e., and circumferentially) only partway toward the other body end 12*b*, 12*a*. Most preferably, the thread first end 17*a* is located at the body first end 12*a* and extends toward the body second end 12*b* for less than about one-tenth of the body overall length L (FIG. 3). With such a thread arrangement, the thread(s) 16 preferably engage with the casing 2 at a location where impact forces $F_A$ are likely to be more directly applied to the distributor 10, i.e., the lower, first end 12*a*, such that the thread 16 prevents any displacement of the body 12 relative to the casing 2. In other words, if the threads 16 were located at the center or second end 12*b* of the body 12, a force $F_A$ applied at the first end 12*a* could cause displacement of body first end 12*a* with respect to the central threaded portion (i.e., compression). As such a force $F_A$ is applied periodically or cyclically during drill operation as the piston 7 reciprocates, periodic compression of the distributor body 12 may potentially lead to premature fatigue failure. However, as such relative displacement and increased risk of fatigue failure is relatively insubstantial, the threads 16 may alternatively be located centrally or may extend from the second end 12*b* inwardly toward the first end 12*a*, which may be desirable for locating other components/portions of the distributor 10 or the casing 2.

Figure 5:
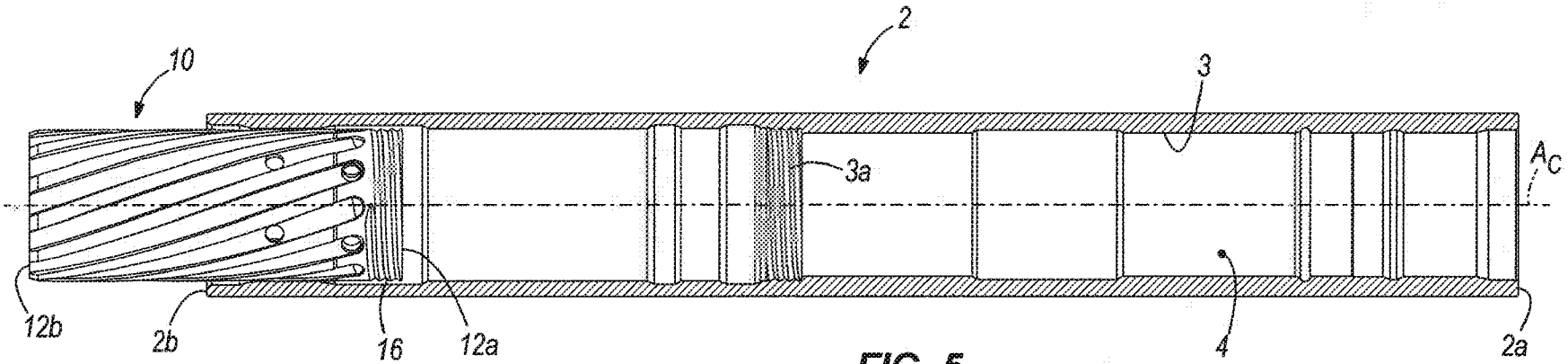
FIG. 5 is another view of the components of FIG. 4, shown with the cylinder inserted into the casing.

With the above structure, the distributor body 12 is configured for installation within the drill assembly 1 by insertion through the casing upper end 2*b*, linear displacement along the casing axis $A_C$ until the threads 3*a*, 16 engage, and then simultaneous rotation and displacement about the axis $A_C$ until the threads 3*a*, 16 interlock. More specifically, prior to assembly, the distributor body 12 is either cooled to temporarily reduce the distributor body OD and/or the casing 2 is heated to temporarily increase the casing inner diameter ID, such that the distributor OD is lesser than the casing ID. Once these components 2, 12 are cooled and/or heated, the distributor body first end 12*a* is first inserted through the upper end 2*b* of the casing 2, as shown in FIG. 5, and then the body 12 is linearly displaced (e.g., "pushed") along the axis $A_C$ until the first end 17*a* of the preferred thread 16 engages with the casing interior thread 3*a*, as depicted in FIG. 6. Thereafter, the distributor body 12 is simultaneously axially displaced along, and angularly displaced about, the casing axis $A_C$ until the interior and exterior threads 3*a*, 16 generally interlock, as shown in FIG. 7. At this point, the distributor body 12 is positioned at the desired location or position $P_D$ on the casing axis $A_C$, at which the distributor cylinder 10 is capable of interacting with other components of the drill assembly 1, as discussed below. Eventually, sufficient thermal energy is transferred to the body 12 and/or out of the casing 2 such that the distributor body 12 expands and/or the casing 2 shrinks so as to form the interference fit as described above, thereby securing the body 12 at the desired axial position $P_D$.

Referring now to FIGS. 2, 3, 9 and 10, the distributor body 12 preferably further has at least one interior chamber 24 (FIG. 2), at least one and preferably a plurality of generally axial fluid passages 26, and at least one and preferably a corresponding number of radial ports 28. More specifically, the body inner circumferential surface 13 defines a central bore 30 extending between the body axial ends 12*a*, 12*b*, such that the body 12 is generally tubular. The bore 30 is sized to receive an upper portion 7*a* of the piston 7 so that a plurality of chambers arc defined or definable in sections of the bore 30 and partly bounded by surfaces of the piston 7. Specifically, a drive chamber 32 is defined in the bore 30 between the upper end 12*b* of the distributor body 12 and the upper end 7*a* of the piston 7 and a return chamber 34 is defined between the upper end 7*a* of the piston 7 and the lower end 12*a* of the distributor body 12. More specifically, the piston 7 has an outer surface 9 extending between the piston upper and lower ends 7*a*, 7*b*, which includes a radially-inwardly stepped portion 9*a*, and the return chamber 34 is defined between the outer surface stepped portion 9*a* and a circumferentially overlapping section(s) of the distributor body inner surface 13. Being partly defined by the movable piston 7, the relative sizes of the drive chamber 32 and the return chamber 34 are variable, and specifically are inversely related, i.e., the size/volume of the drive chamber 32 increases as the supply chamber 34 decreases, and vice-versa.

Further, the one or more fluid passages 26 extend generally axially from the second, upper end 12*b* of the distributor body 12 and toward the body first, lower end 12*a*. Preferably, each passage 26 extends partially circumferentially, so as to be generally spiral-shaped. More specifically, each passage 26 has a first end 27*a* at the distributor body second end 12*b* and a second end 26*b* spaced from the body first end 12*a*, and extends radially inwardly from the body outer surface 14. Furthermore, each radial port 28 extends radially between the distributor body inner and outer surfaces 13, 14 and into a separate one of the fluid passages 26. Preferably, the ports 28 are axially "staggered" such that a first, lower set of ports 29A are each located proximal to the second end 26*b* of the associated passage 26 and a second, upper set of ports 29B are each spaced generally axially from the second end 26*b*. As such, the rate of fluid flow through the ports 28, and thus between the supply chamber 5 and the return chamber 34, can be varied depending on the location of the piston 7, as discussed in greater detail below.

Figure 1B:
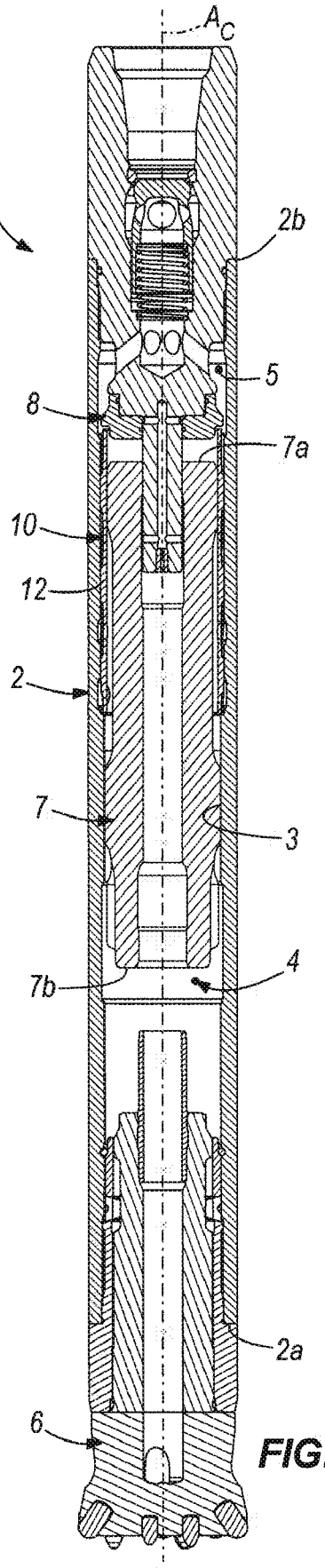
Figure 2:
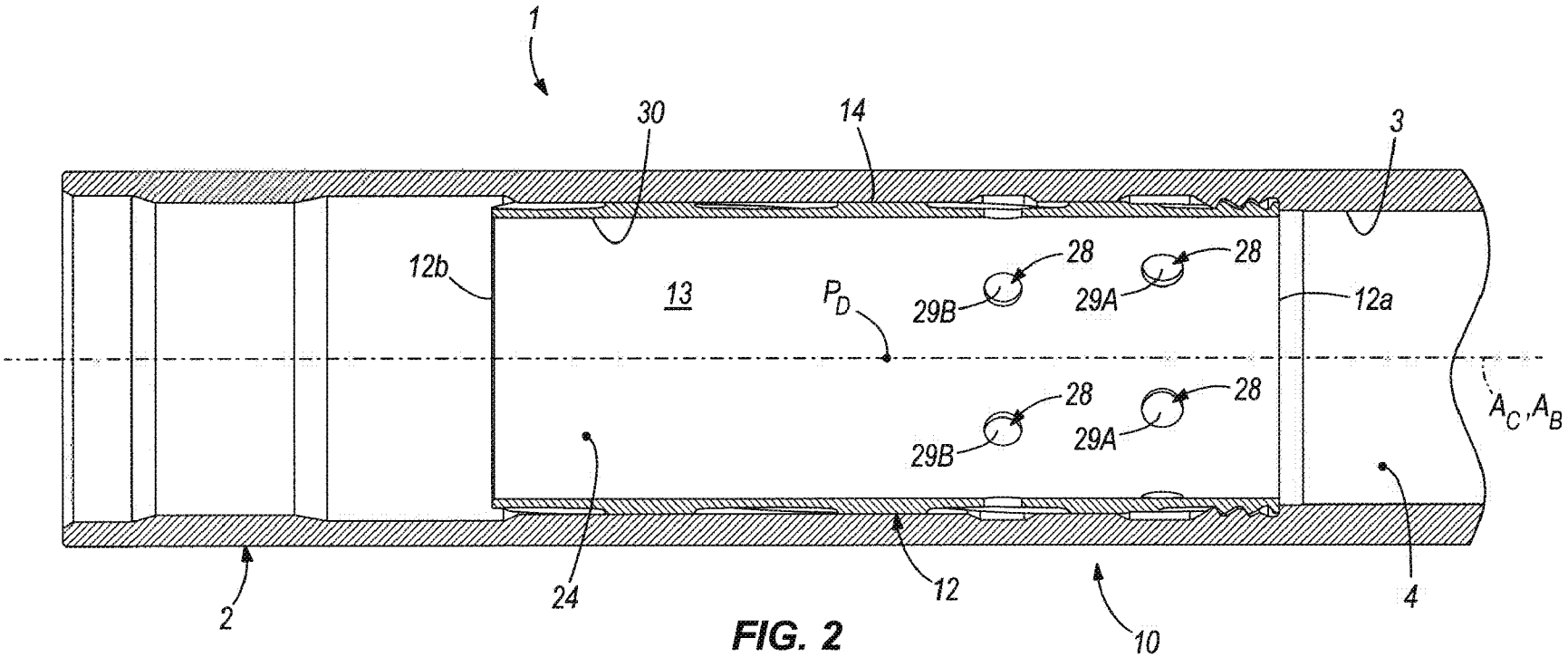
FIG. 2 is an enlarged, partly broken away axial cross-sectional view of the drill assembly, shown with all components removed from the casing except the distributor cylinder.
Figure 9:
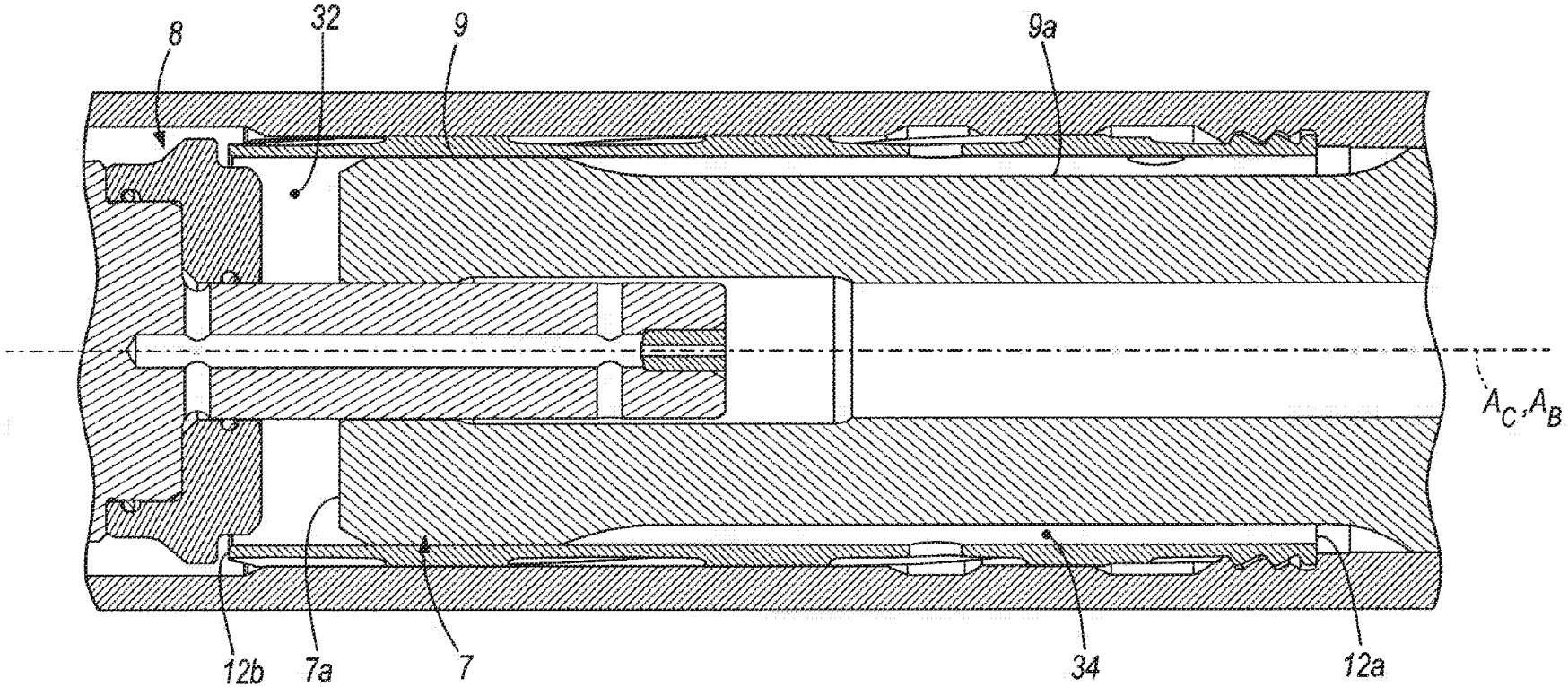
FIG. 9 is an enlarged, broken-away cross-sectional view of the drill assembly, showing the piston at the drive position.
Figure 10:
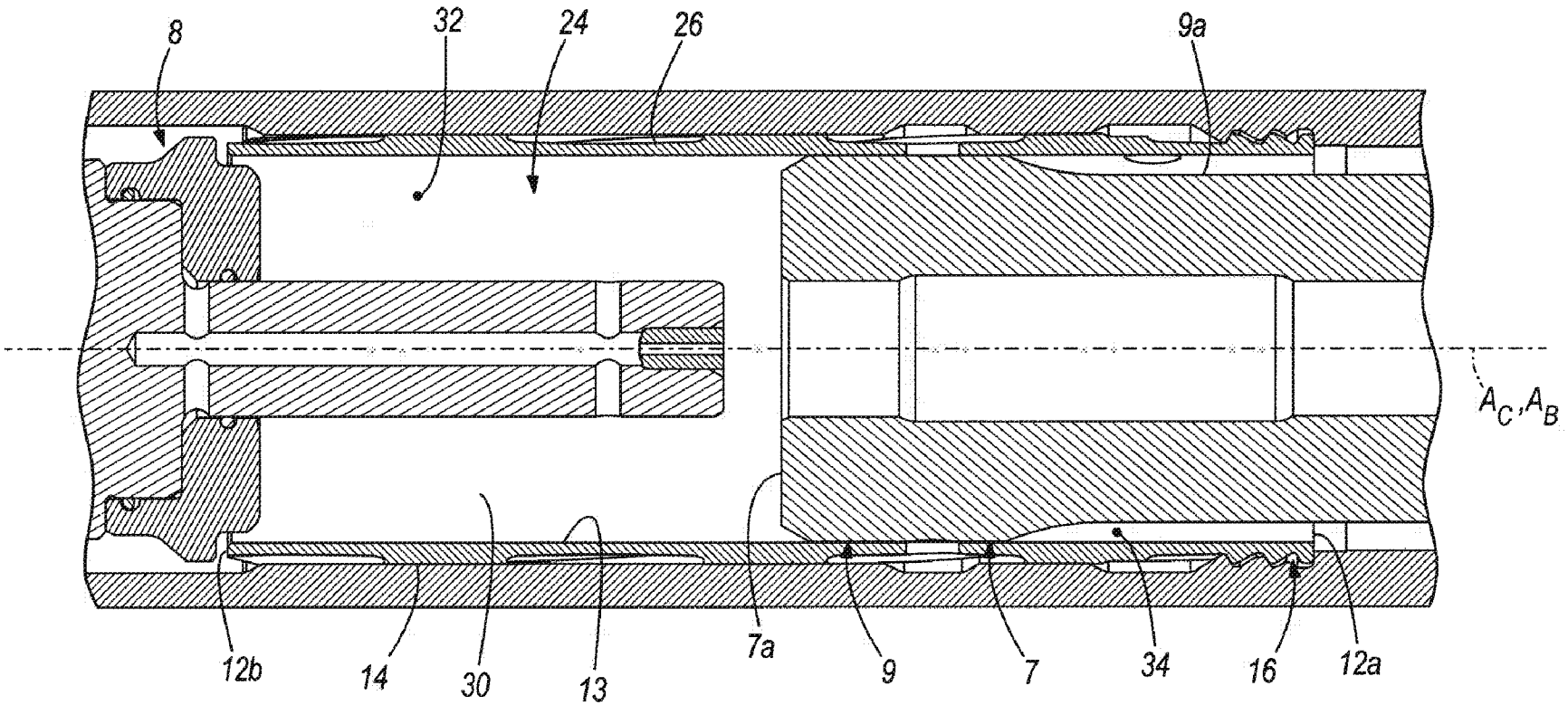
FIG. 10 is another enlarged, broken-away cross-sectional view of the drill assembly, showing the piston at the impact position.
Figure 11:
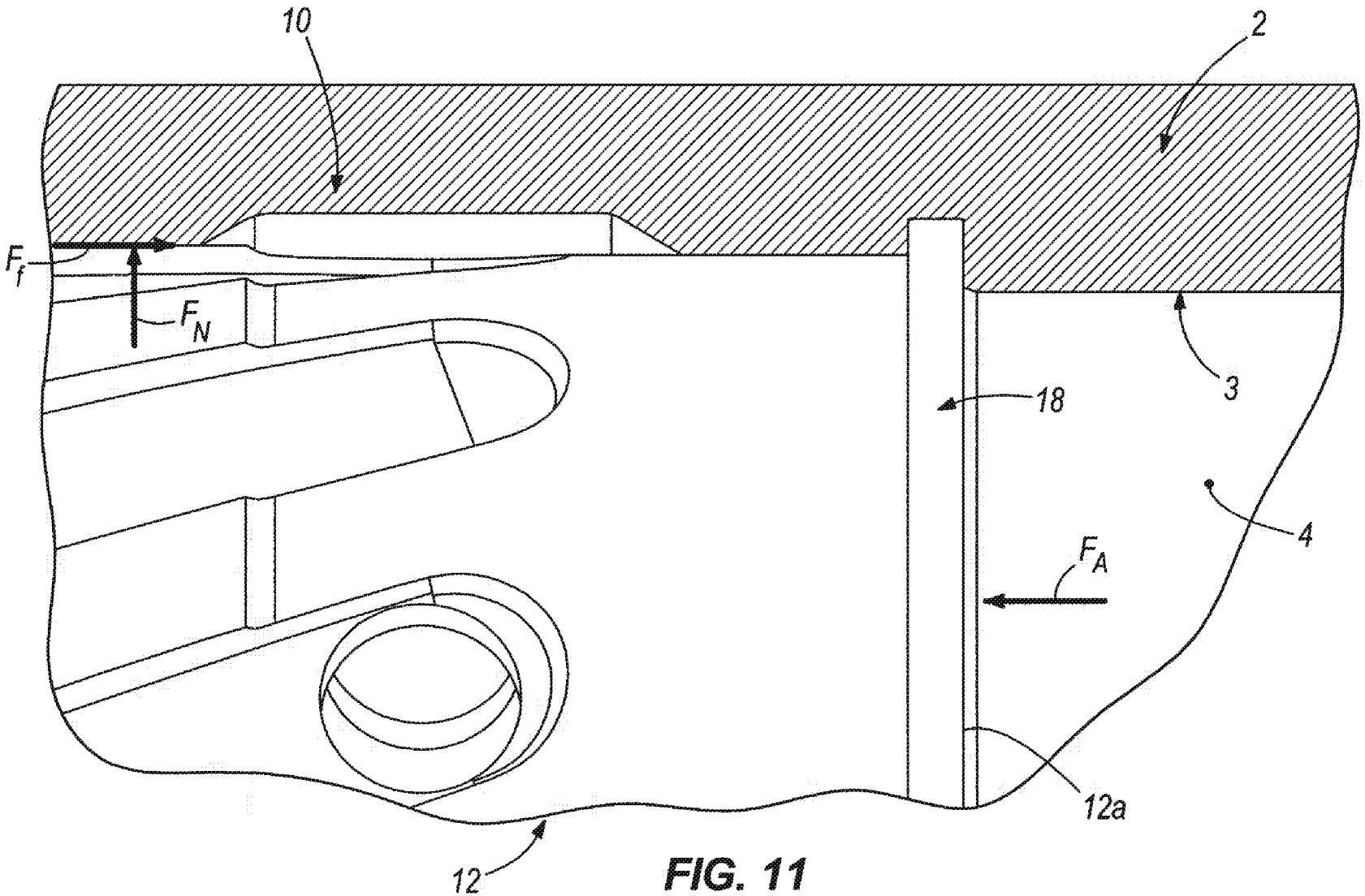
FIG. 11 is a greatly enlarged, broken-away axial cross-sectional view of an alternative distributor cylinder having a shoulder, shown assembled in the casing.

Referring to FIGS. 1, 9 and 10, the distributor body 12 is preferably arranged in the casing 2 such that the body second, upper end 12*b* is located proximal to the fluid supply chamber 5. The valve member 8 is disposed within the casing 2 generally between the supply chamber 5 and the distributor cylinder 10 and is displaceable between an open position $V_O$ (e.g., FIG. 10) and a closed position (not shown). In the open position $V_O$, the valve member 8 is axially spaced from the distributor body second end 12*b* such that the supply chamber 5 is fluidly coupled with the drive chamber 32. In the closed position, the valve member 8 is engaged with the body second end 12*b*, such that the valve member 8 is configured to substantially prevent fluid flow between the supply and drive chambers 5, 32 and permit flow between the supply and return chambers 5, 34. Specifically, fluid flows from the supply chamber 5 into the first ends 27*a* of fluid passages 26, through each passage 26 to the associated port 28, and thereafter into the return chamber 34. In certain positions of the piston 7, both sets of ports 29A, 29B are open, such that the flow into the return chamber 34 is maximized. However, in other positions, the piston 7 is axially located such that a section of the outer surface 9 extends across and seals the second, upper set of ports 29B (see, e.g., FIG. 10), so that the flow into the return chamber 34 is minimized.

Although preferably formed as described above, the distributor cylinder 10 may be constructed in any other appropriate manner. For example, the body 12 may be formed to provide at least a portion of the supply chamber 5, having a valve member disposed inside the bore 30 and engageable with a shoulder providing a valve seat, and including additional radial ports fluidly coupling supply chamber with the fluid passages 26. Further for example, the distributor cylinder 10 may be formed without any fluid passages and only include radial ports 28 fluidly connecting the return chamber 32 with fluid passages formed in the casing inner surface 3. The scope of the present invention includes these and all other distributor cylinder constructions that are configured to engage with a casing inner surface 3 with an interference fit and including one or more exterior threads 16 or/and a radial shoulder 18.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally defined herein.

I claim:

1. A fluid distributor cylinder for a percussive drill assembly, the drill assembly including a casing having an inner circumferential surface defining a central bore, a first central axis extending through the central bore, a bit movably coupled to the casing, and a piston movably disposed within the central bore, the distributor cylinder comprising:

a generally tubular body disposeable within the central bore of the casing, the body including first and second ends, a second central axis extending generally between the first and second ends, an outer circumferential surface, at least a portion of the outer surface being configured to engage the inner surface of the casing to form an interference fit between the body and the casing, and an exterior thread configured to releasably engage the inner surface of the casing to substantially prevent axial displacement of the body with respect to the casing;

wherein the inner surface of the casing has an inside diameter and substantially the entire outer surface of the body has an outside diameter, the body being sized such that the outside diameter is greater than the inside diameter when the distributor cylinder is separate from the casing.

2. The fluid distributor cylinder as recited in claim 1, wherein the exterior thread is configured to prevent displacement of the body relative to the casing when a force is applied to at least one of the body and the casing, the force having a magnitude greater than a friction force between the at least a portion of the outer surface and the inner surface of the casing.

3. The fluid distributor cylinder as recited in claim 1, wherein at least one of:

the outside diameter is about 0.1 percent greater than the inside diameter; and the outside diameter is at least about 0.001 inches greater than the inside diameter.

4. The fluid distributor cylinder as recited in claim 1, wherein the exterior thread has an outer surface with a first outside diameter, and wherein the at least a portion of the outer surface of the body has a second outside diameter, the first outside diameter being substantially equal to the second outside diameter.

5. The fluid distributor cylinder as recited in claim 4, wherein the outer surface of the exterior thread is configured to engage the inner surface of the casing to form an interference fit between the exterior thread and the casing.

6. The fluid distributor cylinder as recited in claim 4, wherein the exterior thread has a first end located at least generally proximal to one of the first and second ends of the body, and a second end located generally between the first and second ends.

7. The fluid distributor cylinder as recited in claim 1, wherein the body further includes an interior chamber, at least one fluid passage, the at least one fluid passage extending radially inwardly from the outer surface of the body and generally axially between the first and second ends of the body, and at least one fluid port extending radially through the body and configured to fluidly couple the at least one fluid passage with the interior chamber.

8. The fluid distributor cylinder as recited in claim 1, wherein the body has a central bore sized to receive a portion of the piston and configured to at least partially define a supply fluid chamber, a drive fluid chamber, and a passage fluidly connecting the supply and drive chambers.

9. The fluid distributor cylinder of claim 1, further comprising a plurality of open sided fluid passages formed in the outer circumferential surface; wherein each fluid passage includes a first end that is at the second end of the tubular body; wherein the fluid passages extend axially and circumferentially along the tubular body, such that the fluid passages are spiral-shaped; wherein the fluid passages terminate at a second end which is spaced from the first end of the tubular body; and wherein the open sides of the fluid passages are closed by the inner surface of the casing.

10. The fluid distributor cylinder of claim 9, wherein the tubular body includes an interior chamber; the fluid distributor cylinder further comprising a plurality of ports communicating through the tubular body; wherein each port communicates between one of the fluid passages; and wherein the fluid passages and ports establish fluid flow communication from the second end of the tubular body, along the outer circumferential surface, and into the interior chamber.

11. A drill assembly comprising:

a casing having an inner surface defining a central bore and at least one interior thread formed in the inner surface;

a bit movably coupled to the casing;

a piston movably disposed within the central bore and contactable with the bit; and a distributor cylinder including a generally tubular body disposed within the central bore, the body having first and second ends, a central axis extending generally between the first and second ends, an outer circumferential surface with at least a portion configured to engage the inner surface of the casing to form an interference fit between the body and the casing, and at least one exterior thread configured to threadably engage with the at least one interior thread of the casing to substantially prevent axial displacement of the body with respect to the casing;

wherein the inner surface of the casing has an inside diameter and substantially the entire outer surface of the body has an outside diameter, the body being sized such that the outside diameter is greater than the inside diameter when the distributor cylinder is separate from the casing.

12. The drill assembly as recited in claim 11, wherein the at least one exterior thread is configured to prevent displacement of the body relative to the casing when a force is applied to at least one of the body and the casing, the force having a magnitude greater than a friction force between the portion of the outer surface of the body and the inner surface of the casing.

13. The drill assembly as recited in claim 11, wherein the at least one exterior thread has a first end located at least generally proximal to one of the first and second ends of the body, and a second end located generally between the first and second ends of the body.

14. The drill assembly as recited in claim 11, wherein:

the casing has upper and lower ends and a second central axis extending between the upper and lower ends, the bit being coupled to the lower end; and the body is configured for insertion through the upper end, for substantially linear displacement generally along the second central axis until the at least one exterior thread engages the at least one interior thread, and for simultaneous axial displacement along and angular displacement about the second central axis until the at least one interior thread and the at least one exterior thread generally interlock.

15. The drill assembly as recited in claim 11, wherein the body further includes a central bore, at least one fluid passage extending radially inwardly from the outer surface of the body and generally axially between the first and second ends, and at least one fluid port extending radially through the body and configured to fluidly couple the at least one fluid passage with the central bore.

16. The drill assembly as recited in claim 15, wherein the piston has an upper end and the central bore is configured to receive the upper end such that a drive fluid chamber is defined between the first end of the body and the upper end of the piston and a return fluid chamber is defined between the upper end of the piston and the second end of the body and about a portion of the piston, the at least one fluid port being fluidly coupled to the return chamber.

17. The drill assembly as recited in claim 16, wherein:

the casing further has a fluid supply chamber defined within the central bore;

the body is arranged in the casing such that the first end is located proximal to the fluid supply chamber and the piston extends through the second end; and the drill assembly further comprises a valve member disposed within the casing generally between the supply chamber and the distributor cylinder, the valve member displaceable between an open position in which the valve member is axially spaced from the first end such that the supply chamber is fluidly coupled to the drive chamber and a closed position in which the valve member is engaged with the first end, the valve member being configured to substantially prevent fluid flow between the supply and drive chambers in the closed position.

18. The drill assembly as recited in claim 17, wherein the at least one fluid passage is fluidly coupled to the supply chamber such that fluid flows from the supply chamber, through the at least one fluid passage and the at least one fluid port, and into the return chamber.

19. The drill assembly of claim 11, wherein at least a portion of the piston reciprocates within the first end of the tubular body; the tubular body further comprising a plurality of open sided fluid passages formed in the outer circumferential surface; wherein each fluid passage includes a first end that is at the second end of the tubular body; wherein the fluid passages extend axially and circumferentially along the tubular body, such that the fluid passages are spiral-shaped; wherein the fluid passages terminate at a second end which is spaced from the first end of the tubular body; and wherein the open sides of the fluid passages are closed by the inner surface of the casing.

20. The drill assembly of claim 19, further comprising a supply chamber communicating with the second end of the tubular body; wherein the tubular body includes a return chamber; the fluid distributor cylinder further comprising a plurality of ports communicating through the tubular body; wherein each port communicates between one of the fluid passages and the return chamber; and wherein the fluid passages and ports establish fluid flow communication from the second end of the tubular body, along the outer circumferential surface, and into the return chamber to cyclically assist raising the piston toward the second end of the tubular body.

* * * * *